US008001871B2

(12) United States Patent
Ferrari

(10) Patent No.: US 8,001,871 B2
(45) Date of Patent: Aug. 23, 2011

(54) CORKSCREW

(75) Inventor: Ruggero Ferrari, Parma (IT)

(73) Assignee: Marisa Marchignoli, Parma (IT)

( * ) Notice: Subject to any disclaimer, the term of this patent is extended or adjusted under 35 U.S.C. 154(b) by 364 days.

(21) Appl. No.: 12/306,391

(22) PCT Filed: Jun. 23, 2006

(86) PCT No.: PCT/EP2006/006056

§ 371 (c)(1),
(2), (4) Date: Dec. 23, 2008

(87) PCT Pub. No.: WO2007/147427

PCT Pub. Date: Dec. 27, 2007

(65) Prior Publication Data

US 2009/0308206 A1 Dec. 17, 2009

(51) Int. Cl.
*B67B 7/62* (2006.01)
*B67B 7/00* (2006.01)

(52) U.S. Cl. ..... 81/3.37; 81/3.29

(58) Field of Classification Search ..... 81/3.37, 81/3.29, 3.33, 3.27, 3.48
See application file for complete search history.

(56) References Cited

U.S. PATENT DOCUMENTS

| | | | | |
|---|---|---|---|---|
| 776,152 | A * | 11/1904 | Strohacker | 81/3.33 |
| 4,590,821 | A | 5/1986 | Olson | |
| 4,729,267 | A | 3/1988 | Giebeler | |
| 5,365,806 | A * | 11/1994 | Paramest | 81/3.09 |
| 6,073,519 | A * | 6/2000 | Presa Eguren | 81/3.33 |
| 2009/0044344 | A1 * | 2/2009 | Ferrari | 7/155 |

FOREIGN PATENT DOCUMENTS

| | | |
|---|---|---|
| DE | 10 2004 016 753 | 11/2005 |
| FR | 675 979 | 2/1930 |
| FR | 710 957 | 9/1931 |

OTHER PUBLICATIONS

International Search Report dated Feb. 6, 2007, from corresponding PCT application.

* cited by examiner

*Primary Examiner* — Debra S Meislin
(74) *Attorney, Agent, or Firm* — Young & Thompson

(57) ABSTRACT

A corkscrew (1) with fulcrum moving and acting alternately in two different positions: the first one to screw the worm into the cork; the second one to extract it. The three operations (screwing, extracting and ejecting the cork) take place with a single reciprocating movement of two-lever (12).

10 Claims, 4 Drawing Sheets

PHASE A

PHASE B

PHASE C
1
3
4
5
8
8a
8b
9
10
11
12
12a
12b
15
17
18
C1
C2
C3

PHASE C
1
2
2a
3
4
5
6
6a
7
8
8a
8b
9
9a
10
13
14
15
16
17
C1
C3

PHASE B
1
2
2a
3
4
5
6
8
8a
8b
10
13
14
15
16
17
C1
C3

PHASE A
1
2
3
4
5
6
7
8b
8a
9a
10
13
14
15
16
17
C1
C3

PHASE C

PHASE B

PHASE A

CORKSCREW

The present invention refers to a corkscrew

Object of the present invention is providing a corkscrew according to the following claims.

The advantages reached by the corkscrew subject of the present invention are the following:

Reduction of the strength required

Reduction of the time required to carry out the operation

Cost reduction

More particularly, by just one simple reciprocating movement of the levers, the corkscrew subject of the present invention screws extracts and ejects the cork.

These objects and advantages are all reached by the corkscrew, subject of the present invention that is characterised by what is included in the below-listed claims.

Figure 1:
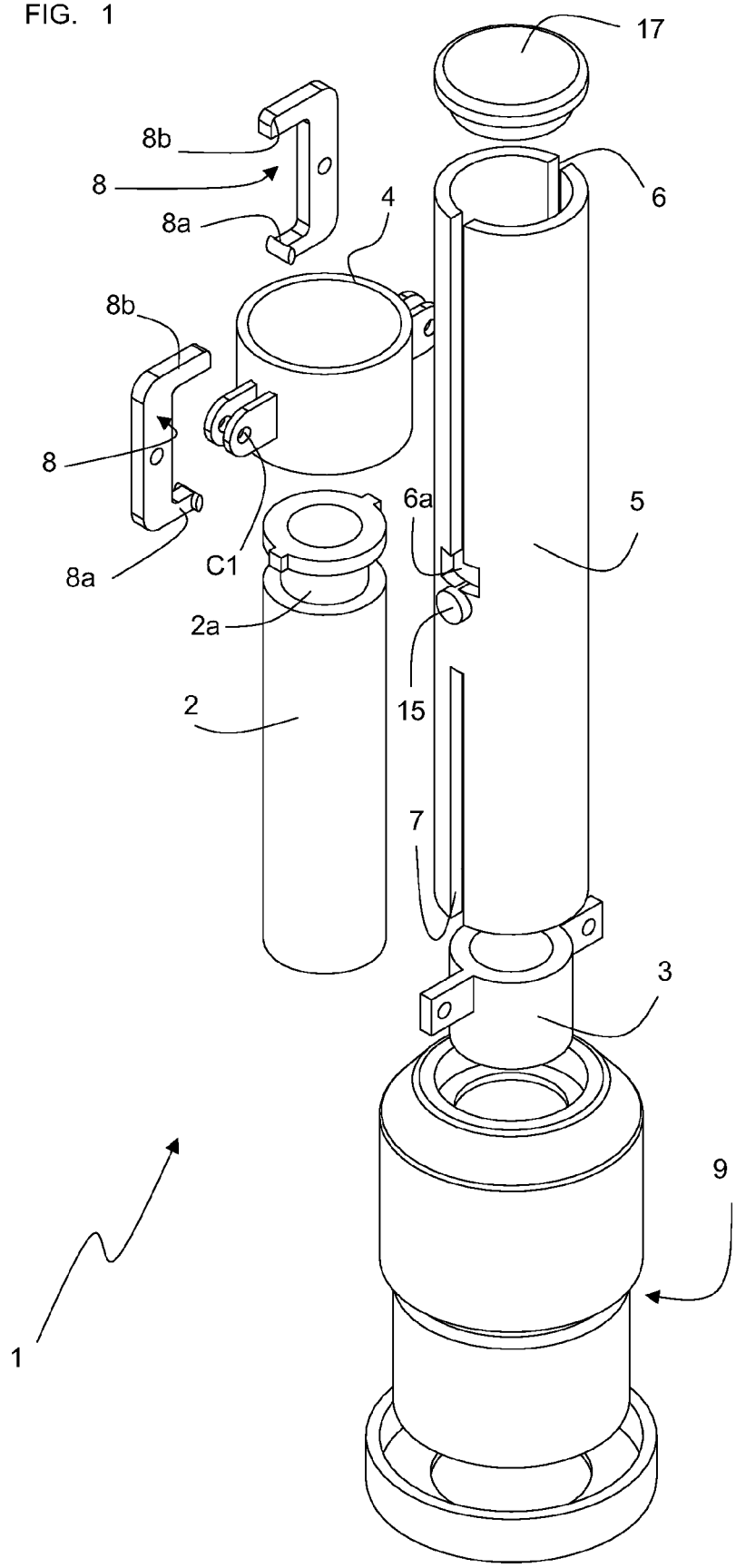
Figures 2, 3, 4:
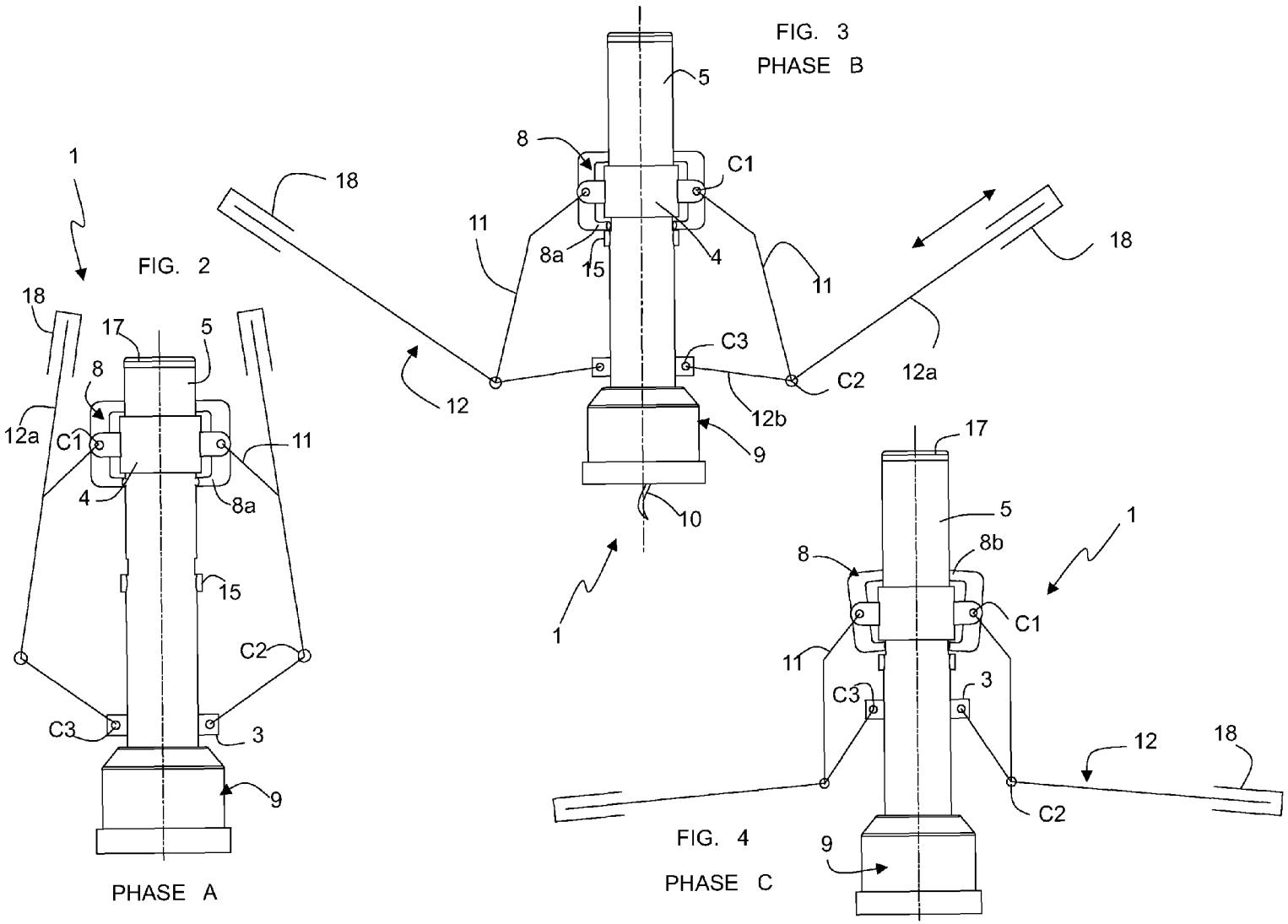
Figure 7:
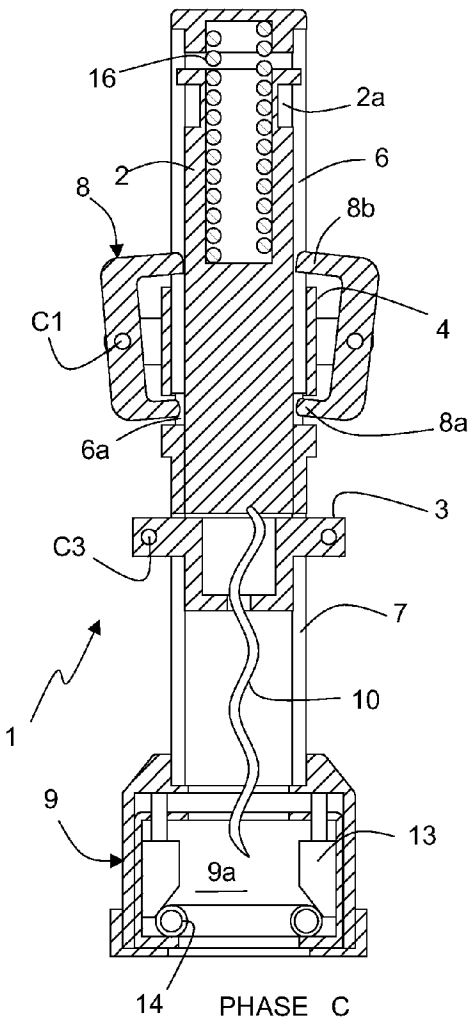
Figure 6:
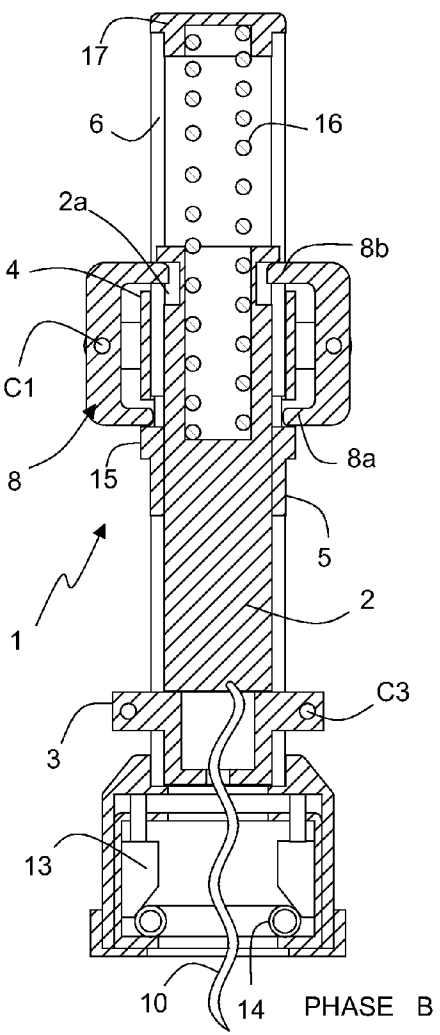
Figure 5:
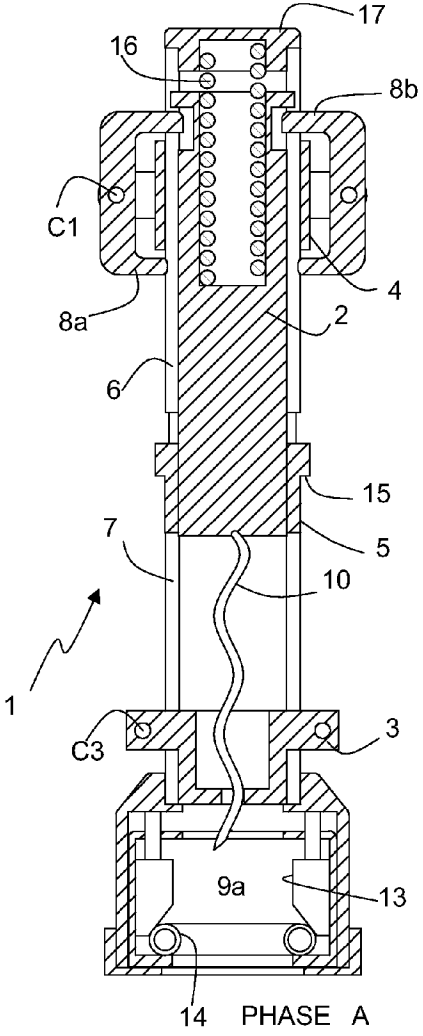

This and other characteristics will be better pointed out by the following description of some embodiments that are shown, merely as a non-limiting example, in the enclosed tables of drawing in which:

FIG. 1 shows An exploded view of the corkscrew subject of the present invention, FIG. 2 shows The corkscrew in its starting arrangement where the worm is prepared and raised, FIG. 3 shows The corkscrew in a second arrangement where the worm penetrates into the cap, FIG. 4 shows The corkscrew in a third arrangement where the cap is extracted, FIG. 5 shows A midsection of the corkscrew according to FIG. 2 arrangement, FIG. 6 shows A midsection of the corkscrew according to FIG. 3 arrangement, FIG. 7 shows A midsection of the corkscrew according to FIG. 4 arrangement.

Figure 10:
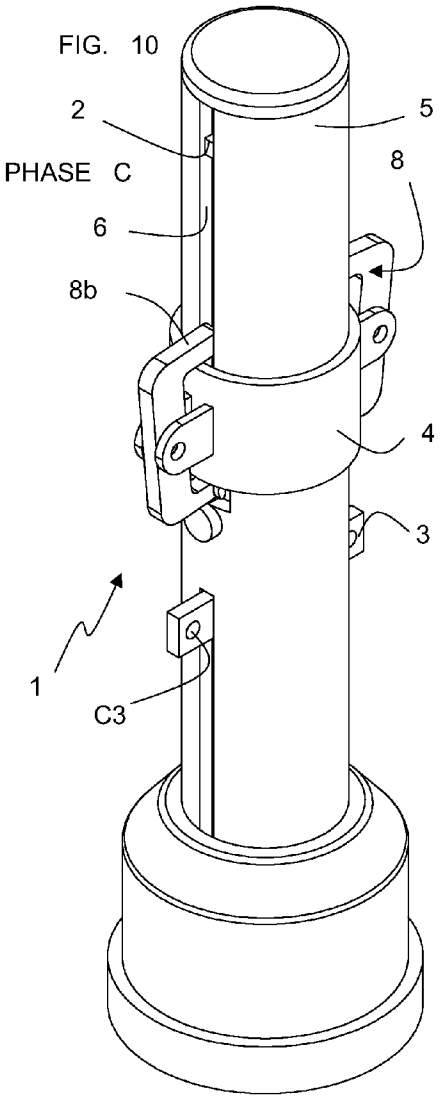
Figure 9:
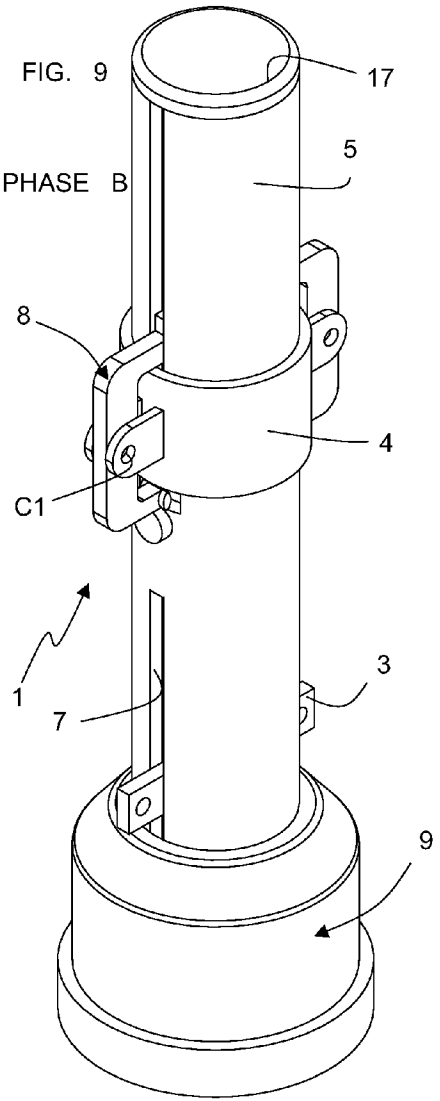
Figure 8:
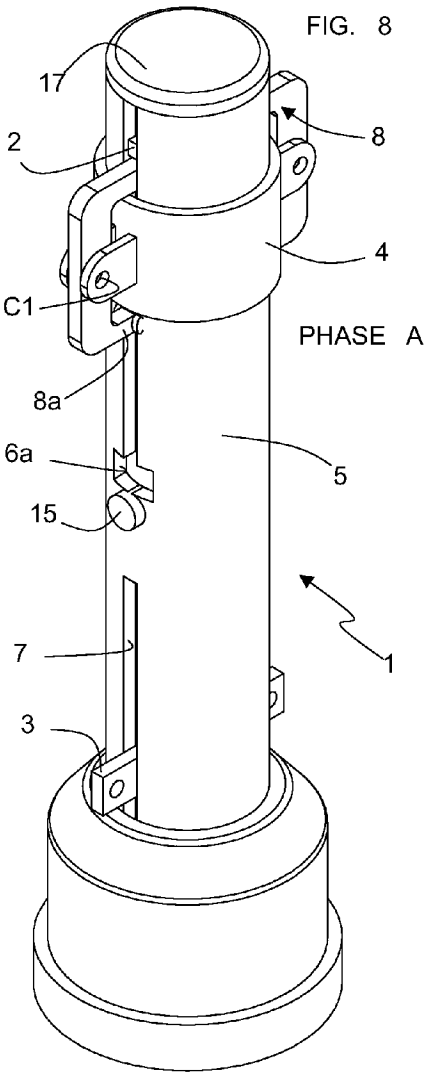

FIGS. 8, 9, 10 show a perspective view of the three above mentioned corkscrew arrangements shown in FIGS. 5, 6 and 7.

With reference to FIGS. 1 and 3, 1 designates a corkscrew different from the others for the following extraordinarily profitable characteristic: its fulcrum is mobile since it is present and acting alternately in two different positions: the first one to screw the worm into the cork, the second one to extract it effortlessly.

Moreover, the three operations (screwing, extracting and ejecting the cork) take place with a single reciprocating movement of two levers, as explained below.

The corkscrew 1 is essentially composed of a hollow tubular body 5 suitable to allow coupling with a corresponding barrel 2, a bush 3 and a neck 4; barrel 2 and bush 3 slide inside said tubular body 5, whereas neck 4 slides along its external skirt.

Barrel 2 and bush 3 are kept in proper position by grooves 6 and 7 obtained at the top and at the bottom of the tubular body 5, namely bush 3 is suitable to engage in lower grooves 7, whereas barrel 2 engages in the above ones designated by reference 6.

Grooves 6 end approximately in the middle of the tubular body 5 with an opening 6*a* into which it is possible to suitably position the tooth 8*a* of a C-shaped hook 8 hinged to neck 4 and free to move with respect to said hinge, in order to mesh with groove 2*a* of barrel 2 or with said opening 6*a*.

Coupling to groove 2*a* is performed through the other upper tooth 8*b*, opposite to the above mentioned tooth 8*a*.

More precisely, corkscrew 1 has two hooks 8 connected on opposite sides but on the same neck 4.

On hinges C1 of hooks 8 have also their fulcrum on one of their ends, rods 11 (shown as generic rods in stick figure form) for operating the neck 4.

The opposite side of said rods 11 is coupled, by another hinge coupling C2, to one of the corkscrew 1 levers 12 (shown as generic levers in stick figure form) for operating the members 2, 3 and 4, as explained below.

Coupling C2 set in the middle of lever 12 obtains two arms 12*a* and 12*b*: arm 12*a* is the veritable operating one, hold by the user when extracting the cap, whereas arm 12*b* is used as transmission for the movement of bush 3 to which it is connected through another hinge coupling C3.

Under bush 3, namely screwed to body 5, is fitted a device 9 for locking the bottle neck, of known type, and including inside a garter spring 14 that is forced by suitable blocks 13 set in circle above said spring 14 to lock the pad: in this way during the screwing phase, the corkscrew 1 is not lifted.

On the lower end of barrel 2 is located, free of rotating according to its own axis which is essentially parallel to that of the tubular body 5, the so-called worm 10 for extracting the cork, whereas the upper end of barrel 2 features a cavity housing a spring 16 that keeps it pressed downwards, according to the positions of the operating levers 12, as explained below.

The tubular body is closed on the top by a cover 17, after fastening on it the previously described members 2, 3 and 4 and spring 16; and on the lower side by the bottle neck locking device 9.

The end of each arm 12*a* can be equipped with extensible handles 18 (shown as generic handle in stick figure form) that reduce the physical extraction effort.

Here below is described the operation of the corkscrew 1, detailed by FIGS. 2 to 10.

Operation occurs in three phases:

The first phase, designated with A, is the preparation of the corkscrew 1 by lifting and locking, if required, levers 12 on the corresponding rods 11. At the same time, the barrel 2 and the worm 10 are lifted by the neck 4 that sets at the upper side of the tubular body 5 carrying also the hooks 8 that during this phase remain inserted into the groove 2*a* by means of the upper teeth 8*b*. The spring 16 is compressed; whereas the bush 3 remains at the lower end of the tubular body 5, namely close to the locking device 9.

After fitting the bottle neck into the space 9*a* of the locking device 9 and tightening the pad by the garter spring 14 (not-shown arrangement) starts phase B that consists in worm 10 inserting into the cork due to barrel 2 descent caused by the lowering of the levers 12. The barrel stops its stroke when it arrives close to, or even against the bush 3, since now teeth 8*a* can enter the cavity 6*a* thus disengaging the corresponding teeth 8*b* from groove 2*a* of barrel 2.

Continuing to lower the levers 12 will obtain to lift and extract the cork since hooks 8 will disengage from groove 2*a* and will fit into cavity 6*a* thus stopping the lifting stroke of neck 4 to which they are hinged; as a consequence levers 12 will lift the barrel 2 through the action of the bush 3 which slides along grooves 7, as described previously. Rising of bush 3 will thus extract the cork by the worm 10 and will compress the spring 16.

Now it just remains to release the uncorked bottle.

As already previously mentioned, during the preparation phase in addition to lift levers 12 it will also be possible to lock them on rods 11 and specifically arms 12*a*.

The outlined solution can be obtained through an arrangement of lever arms and rods such as to insert arm 12*a* into a space created by the splitting of rods 11 arms: it is now possible to create a boss on one member and an indentation on the other one in order to obtain the required locking.

Locking will be manual.

According to a not-shown possible embodiment, spring 16 can be located in a position different than that shown and be inserted between bush 3 and the lower surface of the barrel, i.e. the end housing worm 10, or in both positions.

The tubular body 5 shall preferably have round section, but it could also have whatever section, and the fastening elements 2, 3, 4 shall have the same section as a consequence.

The invention claimed is:

1. A corkscrew (1) comprising:

a tubular body (5) along which can slide a corresponding barrel (2), a bush (3) and a neck (4);

wherein the barrel (2) and the bush (3) being internally sliding and driven by corresponding grooves (6,7) obtained at the top and at the bottom of said tubular body (5), the neck (4) being slidable along said tubular body's external skirt, at least two hooks (8) with a pivot point on hinge couplings (C1) of opposite neck (4) sides; each hook (8) C-shaped and free to move with respect to said hinge (C1) in order to engage two different positions: a first position to lift and to screw a worm into a cork; a second position to extract the cork effortlessly, at least two rods (11) and levers (12) hinged with each other by hinge couplings (C2), such as to define two arms (12*a*, 12*b*) of said levers (12) and connected, to the other end, respectively with said neck (4) at a hinge coupling (C1) and with said bush (3) by another hinge coupling (C3).

2. The corkscrew according to claim 1, wherein said first position is defined by a fitting tooth (8*b*) of the at least two hooks (8) into a groove (2*a*) obtained on the upper side of the barrel (2).

3. The corkscrew according to claim 1, wherein said second position is defined by fitting a tooth (8*a*) of the at least two hooks (8) into an opening (6*a*) obtained at the bottom of a top groove (6) of said grooves (6,7).

4. The corkscrew according to claim 1, wherein on a lower end of the barrel (2) is located the worm (10) for extracting the cork, the worm (10) rotates with respect to the barrel (2).

5. The corkscrew according to claim 1, wherein an upper end of the barrel (2) features a cavity housing a spring (16) that presses downwards in said cavity, according to the positions of the levers (12).

6. The corkscrew according to claim 1, wherein secured to a lower end of the tubular body (5), is fitted a device (9) for locking a bottle neck housing inside a garter spring (14) that is forced by suitable blocks (13) set in circle above said spring (14) to lock a pad of the bottle neck, in this way during the screwing phase, the corkscrew (1) is not lifted.

7. The corkscrew according to claim 1, wherein the arm (12*a*) of the levers (12) is lifted into a space created by the splitting of rod, bosses and indentations, respectively created on both said levers (12) and rods (11), lock the corkscrew (1) in that particular position.

8. The corkscrew according to claim 1, wherein on a lower end of the barrel (2) is located the worm (10) for extracting the cork, the worm (10) rotates with respect to the barrel (2); and wherein the upper end of the barrel (2) features a cavity housing a spring (16) that keeps it pressed downwards, according to the positions of the levers (12).

9. The corkscrew according to claim 1, wherein the ends of each arm (12*a*) are equipped with extensible handles (18) that reduce the physical extraction effort.

10. The corkscrew, according to claim 1, wherein the spring (16) is inserted between the bush (3) and the lower surface of the barrel (2) at the end housing the worm (10).

* * * * *